United States Patent [19]

Smith et al.

[11] 4,394,856

[45] Jul. 26, 1983

[54] COMPRESSION OPERATED INJECTOR WITH FUEL INJECTION CONTROL

[75] Inventors: Richard H. Smith, Birmingham; Donald J. Armstrong, Troy, both of Mich.

[73] Assignee: General Motors Corporation, Detroit, Mich.

[21] Appl. No.: 278,657

[22] Filed: Jun. 29, 1981

[51] Int. Cl.[3] ..... F02M 49/02

[52] U.S. Cl. ..... 123/506; 123/460; 123/458; 123/459; 239/87; 239/585

[58] Field of Search ..... 239/87, 585; 123/506, 123/496, 460, 458, 459, 472

[56] References Cited

U.S. PATENT DOCUMENTS

| | | | |
|---|---|---|---|
| 2,516,690 | 7/1950 | French | 239/87 |
| 2,572,118 | 10/1951 | Dickson | 239/87 |
| 2,800,121 | 7/1957 | Fletcher | 123/460 |
| 3,055,593 | 9/1962 | May et al. | 239/87 |
| 3,610,529 | 10/1971 | Huber | 239/585 |
| 4,129,255 | 12/1978 | Bader, Jr. et al. | 239/585 |
| 4,244,342 | 1/1981 | Fenne | 239/87 |
| 4,247,044 | 1/1981 | Smith | 239/87 |
| 4,306,680 | 12/1981 | Smith | 239/87 |

*Primary Examiner*—Charles J. Myhre
*Assistant Examiner*—Magdalen Moy
*Attorney, Agent, or Firm*—Arthur N. Krein

[57] ABSTRACT

A compression operated diesel fuel injector, for use with an internal combustion engine, is provided with a compression operated piston that is associated with a pump cylinder and plunger to effect pressurization of fuel for discharge from the injector, the piston also defining with the associate injector housing a fuel control chamber. A solenoid actuated valve is operatively positioned to normally block the return flow of fuel from the fuel control chamber to the fuel reservoir for the engine and, a variable flow orifice means is operatively positioned downstream of this valve to control the return fuel flow pressure as a function of engine speed and load to thus regulate the return flow of fuel from the control chamber so as to thereby control engine compression operation of the piston and, accordingly, to correspondingly regulate the rate of fuel injection from the fuel injector.

2 Claims, 2 Drawing Figures

COMPRESSION OPERATED INJECTOR WITH FUEL INJECTION CONTROL

Figure 1:
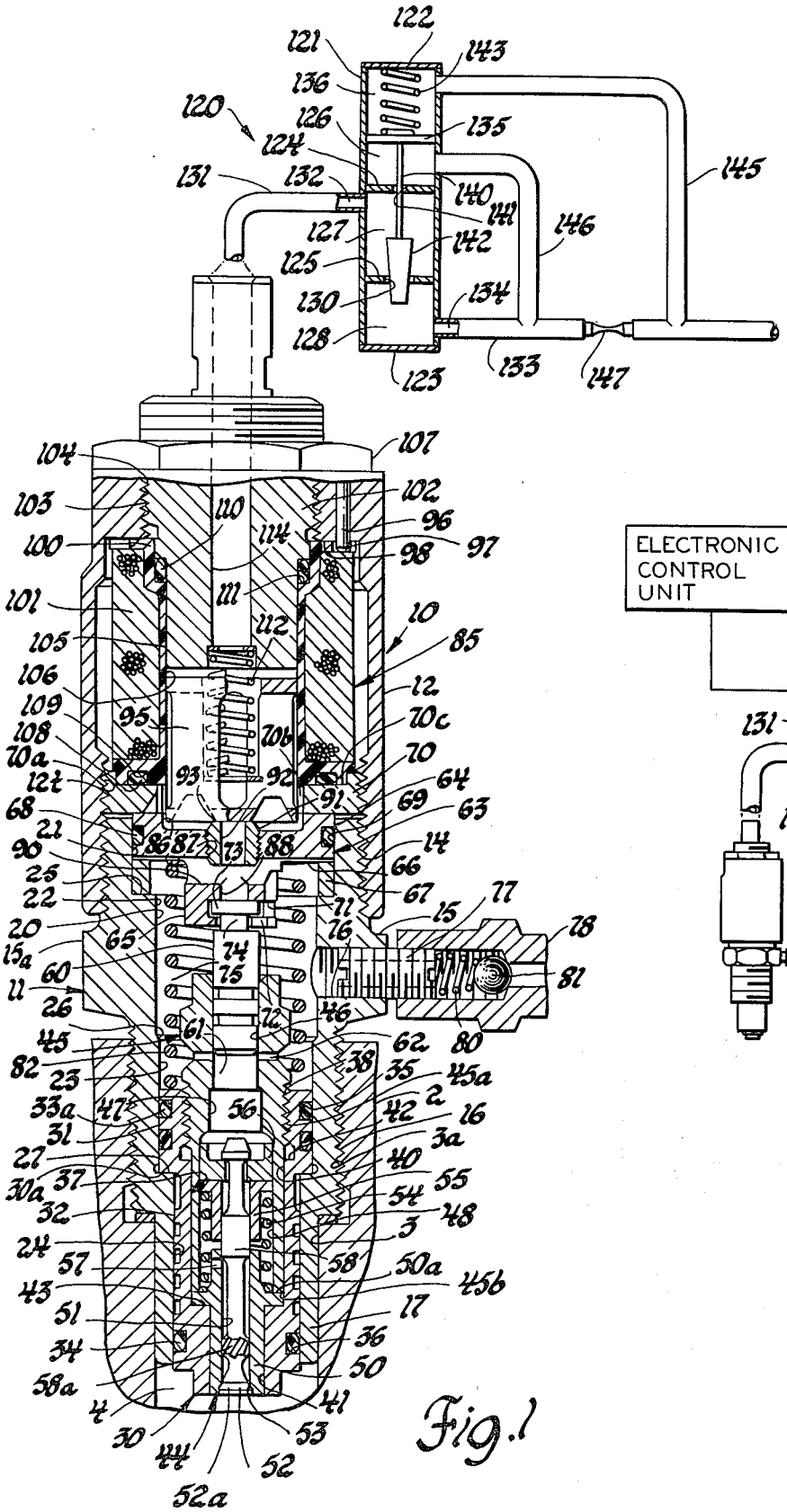

This invention relates to unit fuel injectors for use in delivering fuel directly to the combustion chambers of an engine and, in particular to a compression operated injector with fuel injection control.

Engine compression pressure operated unit fuel injectors are well known in the art. Unit fuel injectors of this type include a pump unit having a piston positioned so as to be responsive to the combustion chamber pressure of an associated combustion chamber in an engine. The piston is operatively associated with a pump plunger and a cylinder bushing in the injector assembly to create the necessary fuel pressure to effect injection of fuel through an injection valve nozzle assembly directly into the combustion chamber of the engine.

In such prior art compression operated injectors it has been conventional to provide mechanical means for controlling the start and end of an injection cycle whereby to also control the quantity of fuel being injected. Being mechanically controlled, such prior art injectors were limited as to their capabilities for the precise controlling of the start and end of injection and for the control of the quantity of fuel being injected.

In modern day engines it is now desirable and necessary to more closely control the operation of the engine so as to reduce the emissions from such engine and to improve fuel economy. In this regard, it is well known in the gasoline internal combustion engine art to utilize electronic fuel injection because of its adaptability to effect more efficient operation of the engine whereby to improve fuel economy and emission control.

Various forms of compression operated injectors have been recently proposed whereby the injection of fuel can be controlled electronically. One type of such a compression operated injector is disclosed in U.S. Pat. No. 4,247,044 entitled Compression Operated Injector issued Jan. 27, 1981 to applicant. In this above-identified type compression operated injector, a compression operated pump element is operative to pressurize fuel and, a solenoid valve is operative to control the flow of such pressurized fuel to the injection nozzle of the assembly. The solenoid valve permits accurate control whereby to effect the start and end of injection and therefore to precisely control the quantity of fuel being injected during each pulse injection period. However, it is now known that during use of this type of compression operated injector in an engine, the fuel injection rate remains relatively constant regardless of engine speed.

It is therefore a primary object of this invention to provide an improved compression operated injector wherein a solenoid valve is incorporated into the injector assembly so as to control the return of fuel from a control chamber on one side of a compression operated element of the injector so as to control the injection of fuel to a combustion chamber and, wherein a variable orifice means is used to regulate the return of fuel as a function of engine speed whereby to control the fuel injection rate.

Another object of this invention is to provide an improved compression operated injector which is adapted to be operated by engine compression pressure and which has a solenoid valve means incorporated therein to control the actual discharge of such pressurized fuel and a variable orifice means to vary the discharge rate of the pressurized fuel as a function of engine speed.

Another object of this invention is to provide an improved compression operated injector having relatively few major components, which components are of relatively simple construction for economy of manufacture and convenience of assembly, and yet cooperate to provide an assembly which is trouble free in operation.

Figure 2:
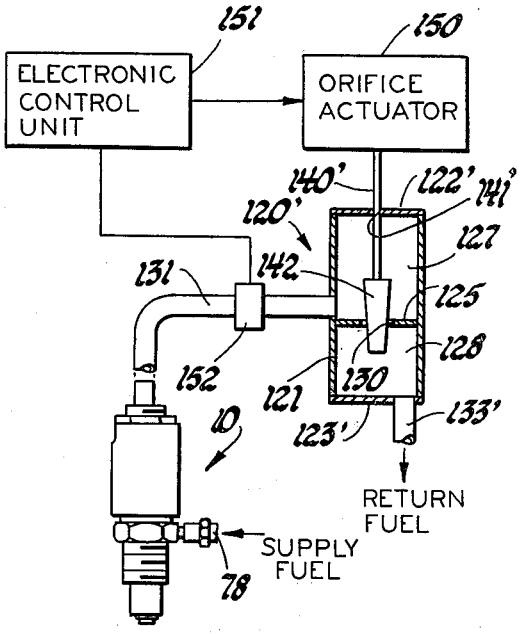

For a better understanding of the invention as well as other objects and further features thereof, reference is had to the following detailed description of the invention to be read in connection with the accompanying drawing, wherein:

FIG. 1 is a longitudinal cross-sectional view of a compression operated injector with fuel injection control constructed in accordance with the invention and showing schematically a preferred embodiment of the variable orifice means used for fuel injection control; and, FIG. 2 is a schematic view of an alternate embodiment of a variable orifice means for use with the injector of FIG. 1.

Referring now to FIG. 1 there is shown a portion of the cylinder head 2 of an engine having a stepped bore 3 extending therethrough to open into a combustion chamber 4 of the engine. As shown, the compression operated injector 10, constructed in accordance with the invention, is mounted to the cylinder head 2 so that its nozzle end projects into the combustion chamber 4.

The compression operated injector 10 includes a cylindrical, hollow two-piece body that includes a tubular injector body 11 and a solenoid body 12 adapted to house the remaining components of the injector assembly.

In the construction illustrated, the injector body 11 is of stepped outer substantially cylindrical configuration so as to define a cylindrical outer externally threaded upper wall 14, an intermediate upper wall 15, preferably of hexagon configuration to provide wrench engaging flats 15*a*, a cylindrical externally threaded lower intermediate wall 16 and, a cylindrical lower wall 17. The walls 16 and 17 are of progressively reduced outside diameters relative to each other in the order identified. As shown, the externally threaded portion 16 is sized so as to mate with the internally threaded portion 3*a* of bore 3 in the cylinder head 2 and, the lower wall 17 is sized so as to be slidably received in the lower portion of bore 3 in the cylinder head.

The injector body 11 is provided with an axial extending stepped through bore 20 to provide a cylindrical upper wall 21, cylindrical upper and lower intermediate walls 22 and 23, respectively, and a cylindrical lower wall 24. Walls 21, 22, 23 and 24 are of progressively reduced internal diameters relative to each other in the order identified. In the construction shown, walls 21 and 22 are interconnected by a flat surface 25. Walls 22 and 23 are interconnected by an inclined surface 26. Walls 23 and 24 are interconnected by a flat surface 27.

A cylindrical tubular piston 30 of stepped external configuration is reciprocably journaled in the injector body 11. For this purpose, the outside cylindrical upper surface 31 of the piston 30 is appropriately sized so as to be slidably received by the cylindrical intermediate lower wall 23 of the injector body while reduced diameter cylindrical lower surface 32 thereof is slidably received by lower wall 24 of injector body 11 whereby this piston will be exposed to the pressure in combustion chamber 4.

The upper and lower skirt portions of the piston 30, as defined by surfaces 31 and 32, are provided with suitable external packing rings 33*a* and 34, respectively, positioned in suitable annular grooves 35 and grooves 36 provided for this purpose in surfaces 31 and 32, respectively, whereby the packing rings are slidable in the associate bore walls 23 and 24.

Piston 30 is of hollow tubular configuration with an axial stepped through bore 37 therein defining an internally threaded cylindrical upper wall 38; a cylindrical intermediate wall 40 and a cylindrical lower wall 41, with these walls being of progressively reduced inside diameters relative to each other in the order identified. Walls 38 and 40 are interconnected by a flat surface 42 and, walls 40 and 41 are interconnected by a flat surface 43.

Positioned within the piston 30 so as to be carried thereby are the conventional components of a nozzle assembly, generally designated 44, that is axially retained by means of a pump bushing 45 in a manner to be described hereinafter.

Although the injector nozzle 44 may be of any suitable type, in the construction illustrated, it is of the type that includes an outward opening, poppet type injection valve. Thus as illustrated, the injection nozzle 44 includes a tubular, nozzle spray tip 50 with a bore 51 therethrough of a size so as to slidably receive a poppet type, nozzle valve 52. The head 52*a* of the valve 52 is adapted to seat against a conical valve seat 53 provided adjacent to the lower end of the bore 51 in nozzle spray tip 50. The nozzle valve 52 is normally biased whereby its head seats against the valve seat 53 by means of a coil spring 54.

As shown, one end of the coil spring 54 abuts against the radial flange 50*a* of the nozzle spray tip 50 while the opposite end of the spring 54 abuts against a spring retainer sleeve 55. The spring retainer sleeve 55 in turn is adapted to abut against a washer-like valve retainer collar 56 suitably fixed to the enlarged end of the nozzle valve 52 opposite the head 52*a* thereof.

In the construction shown, the pump bushing 45 is provided with a stepped bore therethrough to define an upper pump cylinder 46, an intermediate cylindrical wall 47 of an internal diameter greater than that of pump cylinder 46 and, an enlarged internal cylindrical lower wall 48 of a still larger internal diameter that is sized so as to loosely receive the spring retainer sleeve 55 and the valve retainer collar 56. The outside dimension of both of the last two elements 55, 56 being selected relative to the internal diameter of bore wall 48 whereby to provide a suitable annular clearance therebetween for the axial flow of fuel.

Nozzle spray tip 50 is provided adjacent to its upper end with at least one radial through aperture 57 located so as to communicate with the wall of bore 51 at a location between the land 58 and the slotted land 58*a* of the stem of valve 52, that is, at a location adjacent to the reduced diameter portion of this valve stem.

As shown, the pump bushing 45 is suitably fixed to the piston 30, as by engagement of the external threads 45*a* of this pump bushing with the upper threaded wall 38 of the piston, so that the lower end of the skirt 45*b* of the pump bushing 46 will abut against one side of the flange 50*a* of the nozzle spray tip 50 whereby to force the other side of this flange into abutment against the surface 41 of the piston 30.

A cylindrical pump plunger 60, suitably fixed within the body 11 in a manner to be described in detail hereinafter, is adapted to be reciprocably received in the pump bushing 45 to form therewith a pump assembly. The pump plunger 60, as suitably retained within the injector body 11, is positioned so as to cooperate with the pump bushing 45 to form therewith a variable volume pump chamber 61.

To provide for the ingress of fuel to the pump chamber 61, the pump bushing 45, in the construction illustrated, is provided with at least a pair of radial ports 62 axially located so as to be uncovered by the pump plunger 60 when piston 30 is in its extended position, the position shown in FIG. 1. As thus located, the radial ports 62 are adapted to be covered by the pump plunger 60 upon the start of a pump stroke of the pump cylinder and therefor of the piston 30 relative to pump plunger 60.

In the embodiment illustrated, the pump plunger 60 is centrally supported in the injector body 11 as by having it depend from a pole member 63 of a solenoid actuated valve, generally designated 85. Pole member 63, of stepped external circular configuration, is provided with an upper wall 64 of a diameter so as to be slidably received by upper wall 21 of the injector body 11 and a reduced diameter lower wall 65 of a size so as to be loosely encircled by the wall 22 of the injector body. Walls 64 and 65 are interconnected by a flat shoulder 66.

The pole member 63 is thus adapted to be positioned in the injector body 11 with a spacer ring 67 sandwiched between its shoulder 66 and the flat surface 25 of the injector body 11. Pole member 63 is fixed axially within the injector body 11 as by having its upper surface in abutment against a ring-like seat 70 provided with an externally threaded wall 70*a* that is engaged with the internal threads 12*t* at the lower end of solenoid body 12. Seat 70 is provided with a through aperture 70*b* formed, for example, with suitable internal wrenching surfaces whereby it can receive a suitable wrench used to torque it into solenoid body 12.

A suitable seal ring 68 positioned in an annular groove 69 provided in wall 64 of the pole member 63 is used to effect a seal between pole member and wall 21.

Pole member 63, in the embodiment illustrated, is provided, at its lower reduced diameter end, with a radial slot 71 and a key slot 72 to receive the head 73 and reduced diameter stem portion 74, respectively, of the pump plunger 60. With this arrangement, pump plunger 60 is supported so that its lower end can be coaxially aligned with the axis of the bore defined by wall 46 in pump bushing 45.

With the pole member 63 and the pump plunger 60 thus positioned in the injector body 11, these elements together with the upper portion of piston 30 and plunger bushing 45 define a variable volume fuel control chamber 75 partly enclosed by the intermediate upper wall 22 of the injector body. Fuel, at a suitable supply pressure is supplied to the control chamber 75 via a radial inlet passage 76 having a nipple 77 threaded therein whereby this passage can be connected by a supply conduit 78 to a suitable source of fuel. A suitable one-way valve, such as the spring 80 biased ball valve 81, is used to insure that fuel flows through supply conduit 78 in only one direction.

The volume of the fuel control chamber 75 is at a maximum when the piston 30 is in the lowered position, the position shown in FIG. 1, as biased to this position by a compression spring 82. As illustrated, compression spring 82 is positioned to encircle the lower end of pole member 63 and the pump bushing 45 with one end of the spring 82 in abutment against the upper end surface of the piston 30 and with its opposite end in abutment against the flat shoulder 66 of pole member 63. With this arrangement, piston 30 is normally biased downward to the position shown at which the flat surface 30*a* thereof abuts against the flat surface 27 of injector body 11.

It will be apparent that during engine operation, the pressure generated within the combustion chamber 4 during a compression stroke of the associate piston, not shown, will act on the exposed lower end of the piston 30 to move it upward against the bias of spring 82 whereby to pressurize the fuel within pump chamber 61 and also the fuel in control chamber 75, until the opposing effective pressures acting on opposite sides of the piston 30 are equalized. At that time any further upward movement of the piston 30 will only occur upon the release of fuel from the fuel control chamber 75.

Now in accordance with the invention, fuel from the fuel control chamber 75 is released, as desired, by means of a normally closed, solenoid actuated valve, generally designated 85, with this fuel flow from the fuel control chamber 75 further controlled, as shown in FIG. 1, by means of a variable orifice means, generally designated 120.

For this purpose, the pole member 63 is provided with a suitable fuel passage means therethrough. In the construction illustrated, pole member 63 has an axial stepped bore therethrough defining a cylindrical upper wall 86, an internally threaded intermediate wall 87 and a lower wall 88. In addition, a radial bore 90 intersects lower wall 88. As shown, a valve seat insert 91, having a passage 92 therethrough, is threadingly engaged with the wall 87 so that its valve seat 93 which encircles passage 92, projects upward into a chamber defined in part by upper wall 86.

An armature valve member 95, of the solenoid assembly 85, is positioned, in a manner to be described, for movement between a seated and an unseated position relative to the valve seat 93 for controlling flow through passage 92.

The solenoid assembly 85 further includes a tubular coil bobbin 100 supporting a magnetic wire solenoid coil 101 wrapped around it. Solenoid coil 101 is adapted to be connected by suitable electrical leads, not shown, to a suitable source of electrical power via a conventional fuel injection electronic control circuit, not shown, whereby the solenoid coil can be energized as a function of operating conditions of the engine in a well known manner.

Bobbin 100 is supported within the stepped through bore in the solenoid body 12 as by having its lower end centered in the upper countersunk portion of seat 70 defining internal cylindrical wall 70*b* and flat shoulder 70*c* and by having its upper end positioned to abut against a radial shoulder 98 of solenoid body 12. The angular alignment of the bobbin 100 is maintained by means of at least one guide pin 96 positioned in the solenoid body 12 so as to extend into a locating aperture 97 provided for this purpose in the upper flange portion of the bobbin.

A tubular adjusting screw 102 is threaded as at 103 to the internally threaded upper bore wall 104 of solenoid body 12 so that the reduced diameter end 105 of the adjusting screw 102 will extend a predetermined distance into the bore wall 106 of bobbin 100. The lower end surface of screw 102 is thus positioned to serve as a stop for limiting axial movement of the armature valve member 95 in one direction, upward with reference to FIG. 1, when the solenoid is energized. A nut 107 is threaded on external threads 103 of the screw so as to abut against the upper surface of the solenoid body 12.

An annular seal ring 108 positioned in an annular groove 109 provided for this purpose in the lower end of the bobbin 100 is used to effect a seal between the lower end of bobbin 100 and seat 70 while a seal ring 110 positioned in annular groove 111 in the upper internal end of bobbin 100 is used to effect a seal between the bobbin 100 and adjusting screw 102.

During engine operation, fuel from a fuel reservoir, not shown, would be supplied at a suitable supply pressure, as by a supply pump, not shown via conduit 78, nipple 77, and inlet passage 76 to the fuel control chamber 75, when the piston 30 is returning from an end of pump stroke to the position shown in FIG. 1. As will be apparent, fuel from this fuel control chamber 75 can flow via radial ports 62 into the pump chamber 61 when these ports are again uncovered by pump plunger 60.

The piston 30 is fired upward, against the biasing force of the spring 82, from the position shown in FIG. 1, by the engine cylinder gas pressure in the combustion chamber 4 during a compression stroke of the piston, not shown, associated therewith. As this occurs, as the pump bushing 45 moves upward with the piston 30 it will close off the previous flow communication between the fuel control chamber 75 and pump chamber 61, as the pump plunger 60 covers radial ports 62 so that the pressure of the fuel in the pump chamber 61 will increase upon continued upward movement of the piston 30.

However, at the same time, the pressure in the fuel control chamber 75 will also increase until this pressure is sufficient to balance the engine cylinder pressure in the combustion chamber 4 acting on the exposed area of the piston 30. Thus as the engine cylinder pressure rises during the compression stroke it tries to force the piston 30 upwards, but motion is prevented by a hydraulic lock effect due to fuel trapped in the fuel control chamber 30 and of course to the fuel trapped in pump chamber 61. As will now be apparent, the pressure in the fuel control chamber 75 cannot communicate with the drain passage 114 until such time as the solenoid coil 101 is activated so as to permit unseating of the armature valve member 95 from valve seat 93.

When the solenoid coil 101 is energized, as desired, the armature valve member 95 will move upward against the bias of spring 112 to effect its unseating from the valve seat 93 to then allow pressurized fuel from the fuel control chamber 75 to flow to the drain passage 114, thus reducing the pressure of fuel in the fuel control chamber 75 thereby allowing combustion chamber pressure to effect continued upward movement of the piston. As this occurs, fuel in pump chamber 61 is further pressurized and discharged via the injection nozzle assembly 45 into the combustion chamber.

When the solenoid coil 101 is again deactivated, the armature valve member 95 is again forced by spring 112 into seating engagement against the valve seat 93 to block the discharge of fuel from the fuel control chamber 75. As this occurs the nozzle valve 52 will again seat against the valve seat 53 to stop the injection of fuel into the combustion chamber. At the same time, assuming the piston 30 is still on an upward stroke, the pressure in the fuel control chamber 75 will again balance the engine cylinder pressure acting on the piston 30 so that the travel of the piston 30 is again stopped.

Of course, when the pressure in the combustion chamber 4 decreases sufficiently, the spring 82 can again force the piston 30 downward, to the position shown in FIG. 1, thus effecting a suction stroke of the pump plunger 60 relative to the pump bushing 41 to again allow the pump chamber 61 to be filled with a supply of low pressure fuel.

In accordance with the invention, the rate at which fuel is discharged from the injector 10 during the time interval of solenoid coil 101 energization is controlled by means of a variable orifice means 120 that is operative to regulate the rate at which fuel from the fuel control chamber 75 can be returned via drain passage 114 to the fuel reservoir, not shown, for the engine as a function of engine speed.

For this purpose in the embodiment of the variable orifice means 120 shown schematically in FIG. 1 there is provided a tubular housing 121 enclosed at opposite ends by upper and lower covers 122 and 123, respectively, that are suitably fixed thereto. Housing 121 is provided with axially spaced upper and lower partition plates 124 and 125, respectively, to define therewith an upper compartment 126, an intermediate chamber 127, and a lower chamber 128. As shown, plate 125 has a central aperture 130 therethrough to provide for fluid communication between chamber 127 and chamber 128.

Housing 121 is also provided with a conduit fitting 131 which at one end defines an inlet passage 132 to chamber 127 and at its other end is adapted to be suitably connected to drain conduit 114 and, with a conduit fitting 133 defining an outlet passage 134 from chamber 128 and which is adapted to be connected at its opposite end to a fuel reservoir, not shown, containing fuel at substantially atmospheric pressure.

An actuator, such as piston 135 is movably positioned in housing 121 for defining with the upper end of housing 121 and cover 124 an upper chamber 136 and for separating this chamber from compartment 126.

A rod 140 is fixed at one end to the piston 135 so as to depend centrally downward thereof so as to slidably extend through a guide bore 141 in upper partition plate 124 into chamber 127. A cone shaped valve member 142 is fixed to the opposite end of piston rod 140 in position to cooperate with the internal wall defining aperture 130 in plate 125 whereby to define a variable size orifice passage therewith.

A spring 143, located in chamber 136, has one end thereof in abutment against upper cover 122 with the other end positioned to abut against the upper surface of piston 135 whereby to normally bias the piston 135 downward with reference to FIG. 1 so that valve member 142 is moved in an axial direction whereby to reduce the effective flow area of the orifice passage defined by the valve member 142 and aperture 130.

Upper chamber 136 and compartment 126 are in fluid communication via conduits 145 and 146, respectively, with fluid in conduit fitting 133 at location downstream and upstream, respectively, of a restricted flow orifice 147, of predetermined flow area, located in conduit fitting 133.

With this variable orifice means 120 arrangement, the pressure drop thereacross is a function of average fuel injected and will therefore increase with engine speed and load. The variable orifice means 120 is thus operative so as to decrease the return pressure of fuel being forced out of fuel control chamber 75 through drain conduit 114 when faster full injection rates are desired, such as at low engine speed and, to increase this return pressure at higher engine speeds when slower fuel injection rates are desired.

An alternate embodiment of a variable orifice means, generally designed 120', is shown schematically in FIG. 2 wherein similar parts are designated by similar numerals but with the addition of a prime (') where appropriate.

In this alternate embodiment, the housing 121, enclosed at opposite ends by upper and lower covers 122' and 123', respectively, is provided with a single partition plate 125 to form therewith the chambers 127 and 128 that are in flow communication via the aperture 130 in plate 125. As shown, chamber 127 receives fuel from the fuel control chamber 75 of an associated injector 10 via the drain passage 114 therein and the inlet passage 132 in the conduit fitting 131, while fuel from chamber 128 can flow directly to a fuel reservoir via conduit fitting 133'. As shown, the conduit fitting 133' does not require a flow restriction therein in this embodiment.

The rod 140', carrying valve member 142, is positioned so as to slidably extend through a guide bore 141' in upper cover 122' whereby its end opposite valve member 142 can be operatively connected to a suitable electrically operated servo motor or actuator 150 that is operative to effect axial movement of the valve member 142 relative to aperture 130 whereby to vary the size of the flow passage therethrough, as desired.

An electronic control unit 151, having input signals relative to various engine operating conditions such as speed, load and temperature, for example as known in the electronic fuel injection art, is used to select the axial position of the valve member 142 for each preselected operating point and actuates the actuator 150 accordingly to effect movement of the valve member 142 to that point.

Preferably, the electronic control unit 151 is also provided with an input signal of fuel pressure in the conduit fitting 131, by means of a pressure sensor 152. Pressure sensor 152 measures the fuel pressure in conduit fitting 131 and is operative so as to provide a corresponding electrical signal to the electronic control unit 151. The electronic control unit can then operate the actuator 150 to effect movement of valve member 142 in either an opening or closing direction relative to aperture 130, as required, to maintain the desired return fuel pressure, as sensed by pressure sensor 152, in conduit fitting 131 and therefore in drain conduit 114 for each preselected operating condition of the engine.

While the invention has been described with reference to the particular embodiments disclosed herein, it is not confined to the details set forth since it is apparent that various modifications can be made by those skilled in the art without departing from the scope of the invention. For example, although the variable orifice means 120 or 120' are each shown as associated with a single injector 10, if desired, such a variable orifice means can be used to control the return flow of fuel from a plurality of injectors 10. Accordingly, this application is therefore intended to cover such modifications or changes as may come within the scope of the invention as defined by the following claims.

The embodiments of the invention in which an exclusive property or privilege is claimed as defined as follows:

1. In a compression operated diesel fuel injector for use with an internal combustion engine, the fuel injector being of the type having a housing means with a compression operated cylinder means and piston means operatively associated therewith; the cylinder means and piston means defining an injection pump chamber and also defining with the housing means a fuel control chamber; the housing means having a supply passage to the fuel control chamber for supplying fuel thereto and, a fuel return passage from the control chamber for the return of fuel to a source of low pressure fuel; and, a solenoid valve means operatively positioned to normally block flow of fuel from the control chamber to the fuel return passage, the improvement wherein a variable flow orifice means is operatively associated with the fuel return passage next adjacent to the solenoid valve means that is operative to control the pressure of fuel in said fuel return passage upstream of said variable flow orifice means as a function of engine speed and load when the solenoid valve means is energized so as to regulate the flow of fuel from the fuel control chamber whereby to control engine compression operation of the cylinder means and thereby to correspondingly regulate the rate of fuel injection from the fuel injector as a function of engine speed and load.

2. In a compression operated diesel fuel injector, for an internal combustion engine, of the type having a housing means with a compression operated piston means therein, the piston means having a cylinder means thereon; a pump plunger fixed in the housing means and operatively associated with the cylinder means, the cylinder means and pump plunger defining an injection pump chamber and said piston means defining with the housing means a fuel control chamber; the housing means having a supply passage to the fuel control chamber for supplying fuel thereto and, a fuel return passage from the control chamber for the return of fuel to a source of low pressure fuel; and, a solenoid valve means operatively positioned to normally block flow of fuel from the fuel control chamber to the fuel return passage, the improvement wherein a variable flow orifice means is operatively associated with said fuel return passage next adjacent to said solenoid valve means whereby to control the pressure of fuel in said fuel return passage upstream of said variable flow orifice means as a function of engine speed and load when the solenoid valve means is energized, said variable flow orifice means thus being operative so as to regulate the flow of fuel from the control chamber whereby to control engine compression operation of the cylinder means for corresponding regulation of the rate of fuel injection from the fuel injector as a function of engine speed and load.

* * * * *